US010012236B2

(12) United States Patent
Cocks et al.

(10) Patent No.: US 10,012,236 B2
(45) Date of Patent: Jul. 3, 2018

(54) FAN

(71) Applicant: Regal Beloit America, Inc., Beloit, WI (US)

(72) Inventors: Rachele Barbara Cocks, Columbia City, IN (US); Joshua James Westhoff, Fort Wayne, IN (US); Zachary Joseph Stauffer, Fort Wayne, IN (US); Lisa Marie Warriner, Fort Wayne, IN (US); Ludovic Andre Chretien, Columbia City, IN (US); Michael Allen Marks, Fort Wayne, IN (US)

(73) Assignee: Regal Beloit America, Inc., Beloit, WI (US)

( * ) Notice: Subject to any disclaimer, the term of this patent is extended or adjusted under 35 U.S.C. 154(b) by 206 days.

(21) Appl. No.: 14/777,318

(22) PCT Filed: Mar. 12, 2014

(86) PCT No.: PCT/US2014/023961

§ 371 (c)(1),
(2) Date: Sep. 15, 2015

(87) PCT Pub. No.: WO2014/150685

PCT Pub. Date: Sep. 25, 2014

(65) Prior Publication Data

US 2016/0040683 A1 Feb. 11, 2016

Related U.S. Application Data

(60) Provisional application No. 61/789,748, filed on Mar. 15, 2013.

(51) Int. Cl.

| | |
|---|---|
| ***F04D 29/28*** | (2006.01) |
| ***F04D 29/30*** | (2006.01) |
| ***F04D 17/16*** | (2006.01) |
| *F04D 29/24* | (2006.01) |

(52) U.S. Cl.

CPC ..... *F04D 29/283* (2013.01); *F04D 17/16* (2013.01); *F04D 29/282* (2013.01); *F04D 29/30* (2013.01); *F04D 29/242* (2013.01); *F05D 2300/43* (2013.01)

(58) Field of Classification Search

CPC .... F04D 29/283; F04D 29/282; F04D 29/281; F04D 29/242; F04D 29/30; F04D 29/24; F04D 17/16

See application file for complete search history.

(56) References Cited

U.S. PATENT DOCUMENTS

| | | | |
|---|---|---|---|
| 949,150 | A | 2/1910 | Kestner |
| 1,426,581 | A | 8/1922 | McKee |
| 4,708,593 | A | 11/1987 | Banyay |
| 5,558,499 | A | 9/1996 | Kobayashi |
| 5,988,979 | A | 11/1999 | Wang |
| 6,210,118 | B1 | 4/2001 | Egawa et al. |

(Continued)

*Primary Examiner* — Justin Seabe
*Assistant Examiner* — Behnoush Haghighian
(74) *Attorney, Agent, or Firm* — John Wagley

(57) ABSTRACT

A centrifugal fan is described. The fan uses a blade that is tapered across the span of the blade. The taper can be larger towards the end opposite of the inlet or larger at the inlet. The blade may be backwardly inclined and/or curved. The fan may also include a turning vane.

16 Claims, 5 Drawing Sheets

(56) References Cited

U.S. PATENT DOCUMENTS

| | | | | |
|---|---|---|---|---|
| 6,224,335 | B1 * | 5/2001 | Parisi | F04D 29/162 415/206 |
| 6,358,011 | B1 * | 3/2002 | Tetu | F04D 29/282 416/186 R |
| 6,386,683 | B1 | 12/2002 | Hollis | |
| 6,494,676 | B2 * | 12/2002 | Yokoyama | F04D 29/282 415/208.3 |
| 6,942,459 | B2 | 9/2005 | Li et al. | |
| 7,192,254 | B2 | 3/2007 | Li et al. | |
| 7,244,099 | B2 * | 7/2007 | Yamasaki | F04D 29/162 415/173.6 |
| 7,281,897 | B2 * | 10/2007 | Ochiai | F04D 29/282 416/184 |
| 7,311,494 | B2 | 12/2007 | Farag et al. | |
| 8,801,375 | B2 | 8/2014 | Winkler | |
| 8,807,949 | B2 * | 8/2014 | Hammel | F04D 29/662 416/144 |
| 8,870,541 | B2 * | 10/2014 | Imahigashi | F04D 29/30 416/187 |
| 9,022,731 | B2 | 5/2015 | Seccareccia | |
| 9,528,374 | B2 * | 12/2016 | Ikeda | F04D 29/281 |
| 2002/0110455 | A1 * | 8/2002 | Kim | F04D 25/12 416/196 R |
| 2006/0062669 | A1 * | 3/2006 | Nishikawa | F04D 25/06 415/206 |
| 2008/0089025 | A1 | 4/2008 | Winkler | |
| 2010/0202887 | A1 * | 8/2010 | Bohl | F04D 29/162 416/183 |
| 2010/0316498 | A1 | 12/2010 | Cahill et al. | |
| 2010/0329871 | A1 | 12/2010 | Cahill et al. | |
| 2015/0192143 | A1 * | 7/2015 | Sakai | F04D 29/30 415/203 |
| 2015/0316073 | A1 * | 11/2015 | Lorcher | F04D 29/66 416/186 R |

* cited by examiner

FAN

CROSS REFERENCE TO RELATED APPLICATIONS

This application claims benefit of PCT Patent Application No. PCT/US2014/023961 filed Mar. 12, 2014, which claims benefit of U.S. Provisional Application No. 61/789,748 filed Mar. 15, 2013, both of which are incorporated herein by reference in their entirety.

BACKGROUND OF THE INVENTION

The field of the disclosure relates generally to a centrifugal fan for an air moving application, and more specifically, to methods and apparatus for uniform airflow distribution within an air moving system comprised of a centrifugal fan and possibly housing assembly.

Fans and centrifugal fan in particular are used widely for a variety of an air moving application. The air typically is preferred to move in a particular manner. Among terms used to describe air flow is the term flow distribution. Flow distribution describes the uniformity of the flow at the exit of the fan or assembly. Flow quality describes the level of disturbance in the flow such as turbulence, vortices, eddies, or other unfavorable flow structures.

Typically a centrifugal fan has a blade section that is constant across the span of the blade.

Fans and centrifugal fan in particular are used widely for an air moving application. Such applications include those for heating, ventilation and air conditioning, commonly known as HVAC as well as any others including chillers for commercial buildings. Blowers used in furnaces in HVAC commonly used centrifugal fans. For use in such applications and for all fan applications uneven air flow distribution and air flow quality issues are a plaguing problem. Such uneven air flow distribution and air flow quality may negatively affect the efficiency of a fan. Further uneven air flow distribution and flow quality issues may result in excessive noise and vibration as well as reduced service life.

The present invention is directed to alleviate at least one of these problems.

BRIEF DESCRIPTION OF THE INVENTION

In one embodiment, a centrifugal fan is described. The fan uses a blade that is tapered across the span of the blade. The taper can be larger towards the end opposite of the inlet or larger at the inlet.

In an aspect of this embodiment, a turning vane may be added that would separate the volumes of air as it enters into the blades therefore improving the efficiency and flow distribution from the fan.

In another embodiment, a fan is described. The fan includes a plurality of blades. At least one of the blades has a length along a direction parallel to the axis of fan rotation. The at least one of the blades has a width transverse to its length. The width of the at least one of the blades is progressive increasing in width in a direction parallel to the axis of fan rotation and in the direction opposed to air flow.

In an aspect of this embodiment, an element is placed in the internal air flow passage of the fan. The element may be a turning vane. The turning vane may include a smoothly-rounded entry nose and a thin extended trailing edge. The turning vane may be circular ring internally mounted to tine internal periphery of the blades. Further, multiple turning vanes may be used across the fan. Such multiple turning vanes may each be identical to each other in a particular far or some or all may be different from some each other in a particular fan.

In an aspect of this embodiment, at least one of the fan blades is a backward inclined fan blade. A backward inclined fan blade is a type of centrifugal fan blade in which the blades is inclined such that its ends are pointing in the opposite direction to the rotation of the fan wheel. The fan blade is adapted to provide a non-overloading characteristic.

In an aspect of this embodiment, the fan is adapted to provide improved fan efficiency.

In another an aspect of this embodiment, the fan is adapted to provide improved flow quality providing reduced flow driven sound.

In another an aspect of this embodiment, the fan is adapted to provide improved inertial and dynamic balance.

In another an aspect of this embodiment, the fan is adapted to provide improved flow distribution.

In another an aspect of this embodiment, the fan is adapted to provide reduction of active material.

In another embodiment, a fan is described. The fan includes a plurality of blades. At least one of the blades has a length along a direction parallel to the axis of fan rotation. The at least one of the blades has a width transverse to its length. The width of the at least one of the blades is progressive decreasing in width in a direction parallel to the axis of fan rotation and in the direction of air flow.

In an aspect of this embodiment, at least one of the fan blades is a backward inclined fan blade. A backward inclined fan blade is a type of centrifugal fan blade in which the blades is inclined such that its ends are pointing in the opposite direction to the rotation of the fan wheel. The fan blade is adapted to provide a non-overloading characteristic.

In an aspect of this embodiment, the fan is adapted to provide improved fan efficiency.

In another an aspect of this embodiment, the fan is adapted to provide improved flow quality providing reduced flow driven sound.

In another an aspect of this embodiment, the fan is adapted to provide improved inertial and dynamic balance.

In another an aspect of this embodiment, the fan is adapted to provide improved flow distribution.

In another an aspect of this embodiment, the fan is adapted to provide reduction of active material.

In another embodiment, a fan is described. The fan includes a plurality of blades. At least one of the blades is a turning vane. The turning vane is one of a single or multiple turning vane the turning vane has x, y and z.

In another an aspect of this embodiment, the fan is adapted to provide improved fan efficiency.

In another an aspect of this embodiment, the fan is adapted to provide improved flow quality providing reduced flow driven sound.

In another an aspect of this embodiment, the fan is adapted to provide improved flow distribution.

In another an aspect of this embodiment, the fan is adapted to provide improved blade assembly stiffness.

In another embodiment, a fan is described. The fan includes a plurality of blades. At least one of the blades has a length along a direction parallel to the axis of fan rotation. The at least one of the blades has a width transverse to its length. The width of the at least one of the blades is progressive increasing in width in a direction parallel to the axis of fan rotation. The fan may also include a turning vane and may include multiple turning vanes.

In another an aspect of this embodiment, the fan is adapted to provide improved fan efficiency.

In another an aspect of this embodiment, the fan is adapted to provide improved flow quality providing reduced flow driven sound.

In another an aspect of this embodiment, the fan is adapted to provide improved flow distribution.

In another an aspect of this embodiment, the fan is adapted to provide improved blade assembly stiffness.

In another an aspect of this embodiment, the fan is adapted to provide reduction of active material.

In another an aspect of this embodiment, the fan is adapted to provide improved inertial and dynamic balance.

DETAILED DESCRIPTION OF THE INVENTION

Figure 1:
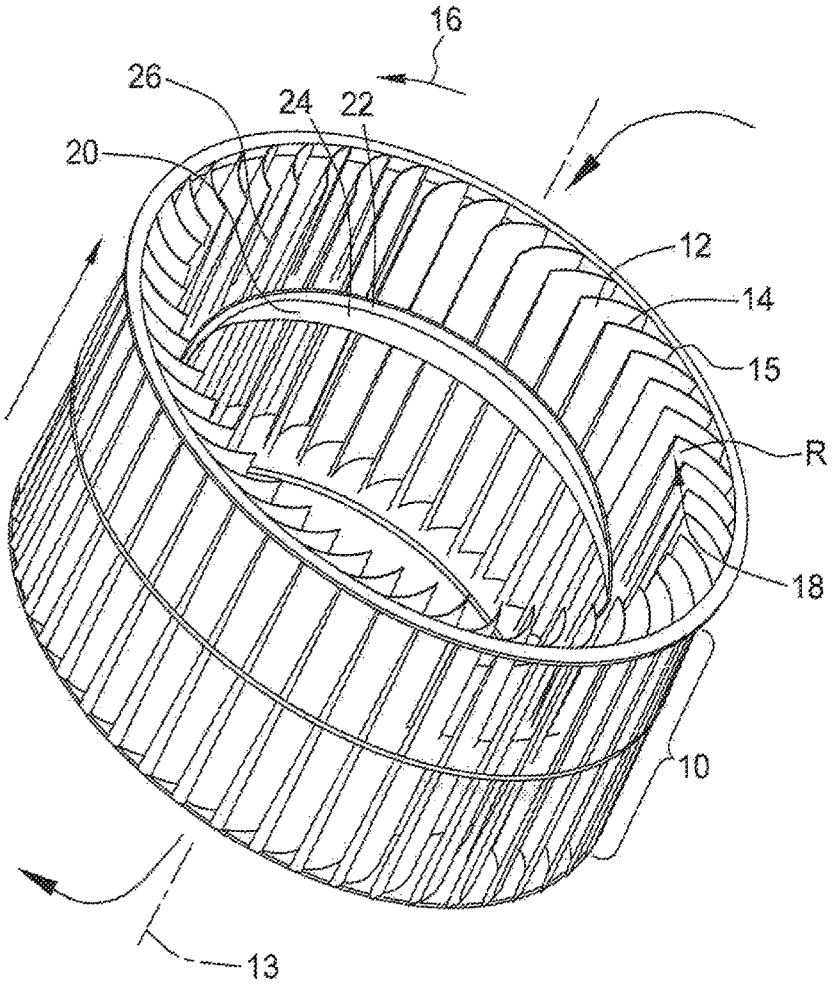
FIG. 1 is a perspective view of the one embodiment of a fan according to the present invention including tapered blades and a turning vane.

Referring first to FIG. 1, an embodiment of the invention is shown as a centrifugal fan 10. The fan 10 has a plurality of tapered blades 12. The fan 10 rotates about axis of rotation 13. The blades 12 may as shown be oriented such that the blades 12 are inclined such that their first and second ends 14 and 15, respectively, are pointing in the direction of the rotation 16 of the fan 10. This blade direction configuration is known as forwardly inclined blade configuration. It should be appreciated that the fan may be backwardly inclined or have a radial configuration.

As shown the blades 12 are curved and defined by a radius R and a centerline 18. It should be appreciated that the fan blades may be straight or may be curved in an orientation opposite that shown. It should be appreciated that the fan blades may have an arcuate shape more complex than a circular arc or may be bent.

An element 20 may, as shown is placed in the internal air flow passage of the fan. Such an element may be generally known as a baffle. The element or baffle 20 may be a turning vane and will be described as such hereinafter. However, it should be appreciated that the baffle may be a flow straightener or separator or any device that baffles or turns the air flowing in or through a fan. It should be appreciated that any of the devices that may baffle or turn the air flowing in or through a fan including, but not limited to a flow straightener or separator may be positioned in a similar fashion and in similar locations to those described herein for turning vanes.

The turning vane 20 may include a smoothly-rounded entry nose 22 and a thin extended trailing edge 24. The turning vane 20 may be a circular ring internally mounted to the internal periphery 26 of the blades 12. As shown the thin extended trailing edge 24 of the turning vane 20 intersects the blades 12. The turning vanes may alternatively only touch and not intersect the blades. Further, the turning vanes may completely intersect the blades. Further, the turning vanes may be mounted through the blades and even completely intersect the blades. While, as shown, the turning vane 200 is mounted to the internal periphery 26 of the blades 12, it should be appreciated that the turning vane may be mounted to the blades on the outer side of the blades.

It should be appreciated that the fan with tapered blades of the present invention may be an axial or centrifugal or any other known fan.

Figure 2:
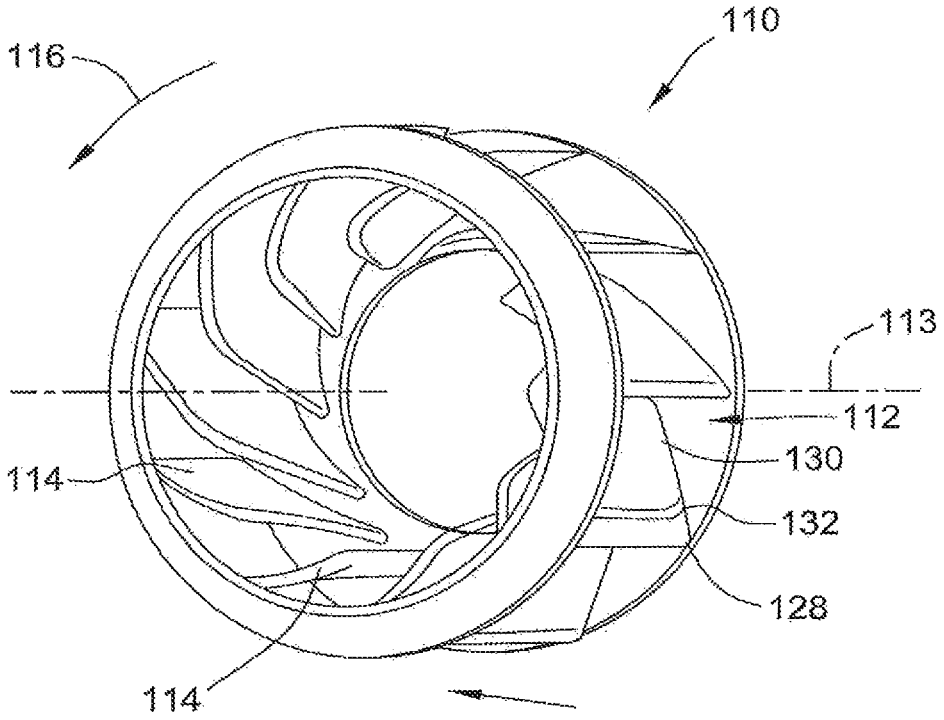
FIG. 2 is a perspective view of the another embodiment of a fan according to the present invention including tapered blades.

Referring now to FIG. 2, an embodiment of the invention is shown as a centrifugal fan 110. The fan 110 has a plurality of tapered blades 112. The fan 110 rotates about axis of rotation 113. The blades 112 may as shown be oriented such that the blades 112 are inclined such that their ends 114 are pointing in the opposite direction to that of the rotation 116 of the fan 110. This blade direction configuration is known as backwardly inclined blade configuration. It should be appreciated that the fan may be forwardly inclined or have a radial configuration. The blades 112 may, as shown, be generally planar and had an outer portion 128 and an inner portion 130 separated by a bend 132.

The fan 110 is an example of a backward inclined airfoil design fan with tapered blade section.

Figure 3:
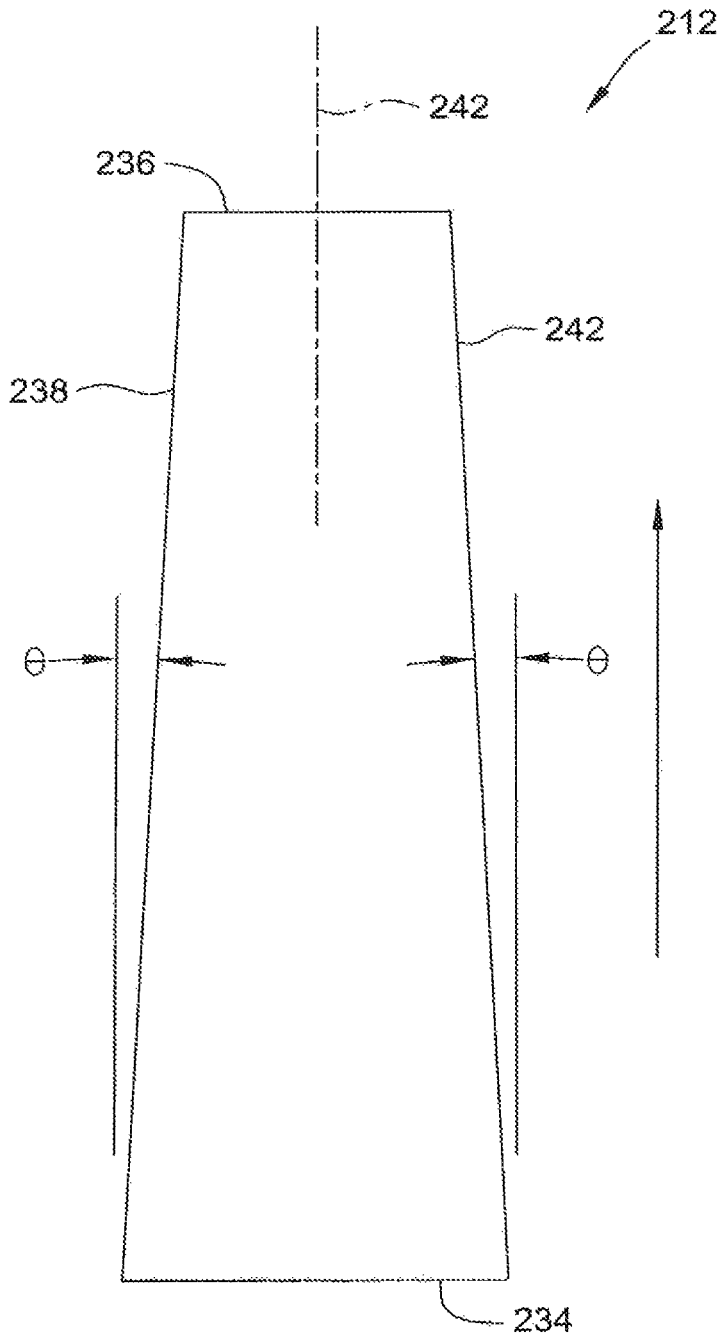
FIG. 3 is a plan view of one embodiment of a tapered fan blade according to the present invention.

Referring now to FIG. 3, an embodiment of the invention is shown as a centrifugal fan blade 212. The fan blade 212 is typically one of a plurality of tapered blades 212, only one of which is shown for use with a centrifugal fan (not shown). The blade 212 is as shown a single tapered blade 212. The blade 212 as shown is preferably curved or arcuate in cross section, but may be planar or have any suitable shape or cross section. The blade 212 is defined by a first end 234 and a parallel spaced apart second end 236. The ends 234 and 236 are connected by first and second sides 238 and 240 respectively. The sides 238 and 240 diverge from first end 234 to second end 236 and as show form blade angle θ from centerline 242 of the blade 212. It should be appreciated that the blade angle θ may be different on each of the sides 238 and 240. The blade 212 as shown may be used on a forward inclined fan design. It should be appreciated that the fan blade 212 may be used on a backwardly inclined fan design or a radial design.

Figure 4:
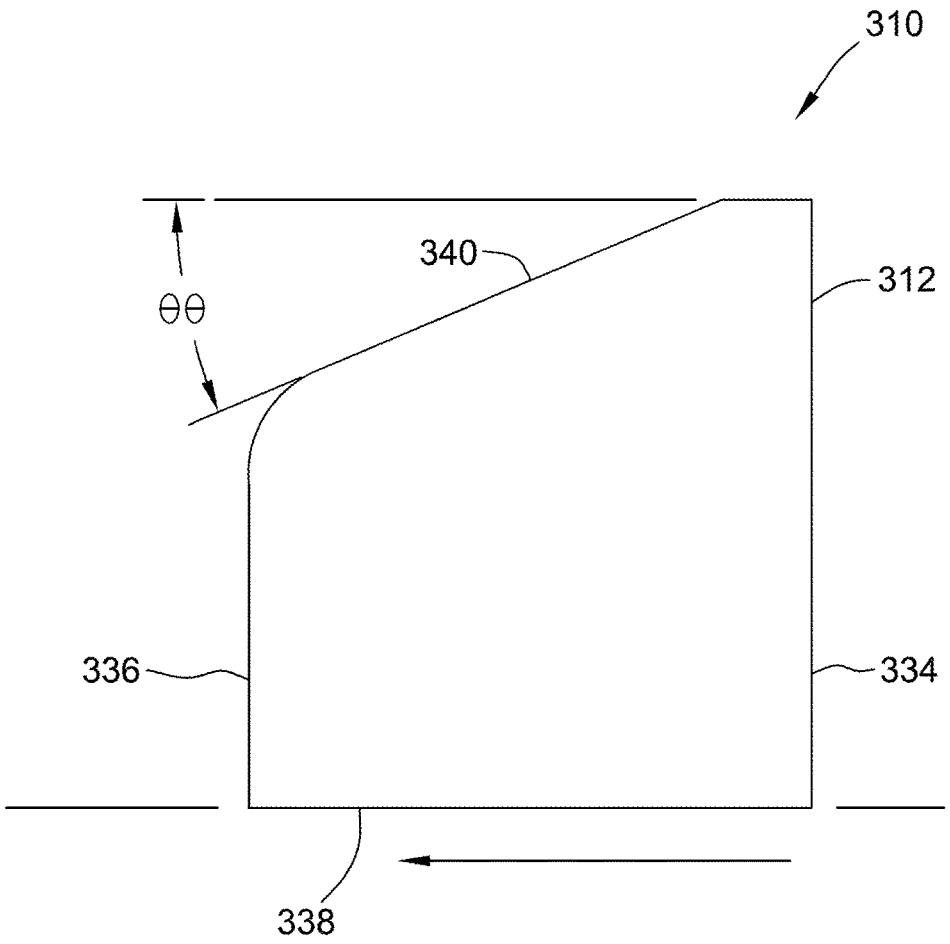
FIG. 4 is a plan view of the another embodiment of a tapered fan blade according to the present invention.

Referring now to FIG. 4, an embodiment of the invention is shown as a centrifugal fan blade 312. The fan blade 312 is typically one of a plurality of tapered blades 212, only one of which is shown for use with a centrifugal fan (not shown). The blade 312 is as shown a single tapered blade 312. The blade 312 is preferably curved or arcuate in cross section, but may be planar or have any suitable shape or cross section. The blade 212 is defined by a first end 334 and a parallel spaced apart second end 336. The ends 334 and 336 are connected by first and second sides 338 and 340 respectively. The second side 340 diverges from first side 338 from first end 334 to second end 336 and as show forms blade angle ΘΘ from first side 338 of the blade 312. The blade 312 as shown may be used on a forward inclined fan design. It should be appreciated that the fan blade 312 may be used on a backwardly inclined fan design or a radial design.

Figure 5:
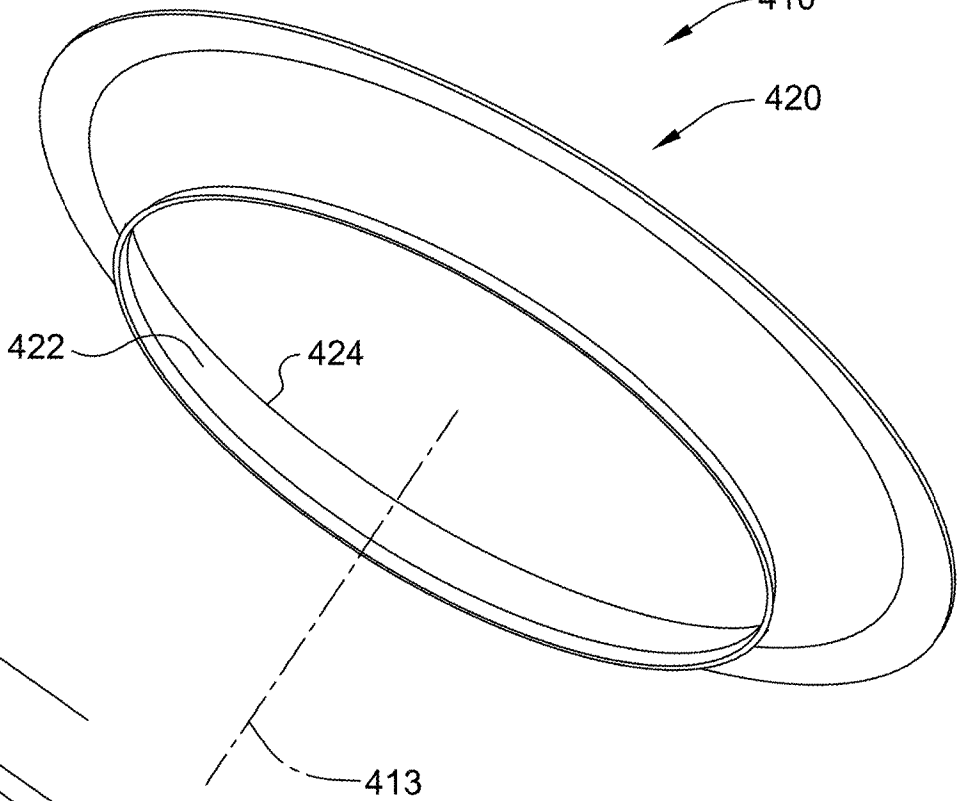
FIG. 5 is a perspective view of one embodiment of a turning vane according to the present invention.
Figure 6:
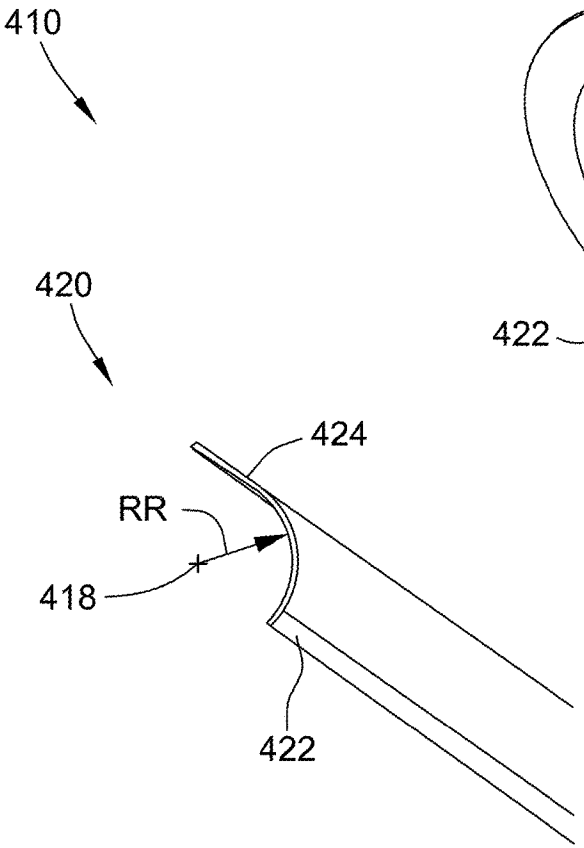
FIG. 6 is a cross sectional view of the turning vane of FIG. 5 along the line 6-6 in the direction of the arrows.

Referring now to FIGS. 5 and 6, an embodiment of the invention is shown as a centrifugal fan 410. The fan 410 rotates about axis of rotation 413. The fan 410 as shown includes a turning vane 420. The turning vane 420 may, as shown, include a smoothly-rounded entry nose 422 and a thin extended trailing edge 424. The turning vane 420 may be a circular ring internally mounted to the internal periphery of the blades. It should be appreciated that the turning vane may be mounted to the blades on the outer side of the blades. As shown the rounded entry nose 422 is curved and defined by a radius RR and a centerline 418.

It should be appreciated that multiple turning vanes (not shown) may be used across the span of the centrifugal fan. These turning vanes may extend to various depths inside of the fan inlet volume. The curvature of the turning vane is intended to capture incoming flow and separate the volume of air to improve the distribution of the airflow exiting the fan.

The improved distribution across the blades provided by the use of a fan with tapered blades, whether forwardly inclined, backwardly inclined, radial, curved or planar, and whether including a turning vane or not, improves the efficiency of the fan and the reduction in flow disturbance downstream improves the overall sound quality of the system. Sound quality is improved by reduction of flow driven noise and instabilities by evening out the flow distribution through the housing.

It should be appreciated that the features of the various embodiments may be combined in any possible way to provide the advantages of the present invention. Further, for example, each of the blade sections between the added turning vanes may have various tapered sections.

The blade, turning vanes and other fan components as well as the fan may be made by any available manufacturing process and may be made of any suitable durable materials, including but not limited to metals, polymers and composites.

What is claimed is:

1. A centrifugal fan, having an inlet and an outlet, said fan comprising:

a support structure defining an axis of rotation thereof;

a plurality of blades, each of said plurality of blades connected to said support structure, each of said plurality of blades having a length along a direction parallel to the axis of rotation of said support structure extending from a first side of said one of said plurality of blades to an opposed second side of said one of said plurality of blades and having a width transverse to its length and extending from a radially inward first end of said one of said plurality of blades to an opposed radially outward second end of said one of said plurality of blades, said plurality of blades defining an internal periphery thereof; and a turning vane connected to the plurality of blades and positioned centrally along the length of the blades, said turning vane including a trailing edge secured to the internal periphery of said plurality of blades and a smoothly rounded nose extending radially inward from the trailing edge.

2. The fan of claim 1, wherein said turning vane comprises:

a smoothly rounded entry nose; and an extended trailing edge.

3. The fan of claim 2:

wherein said support structure defines opposed first and second faces transverse to the axis of rotation of said support structure; and wherein said turning vane is positioned between the first and second faces and spaced from the first face of said support structure and spaced from the second face of said support structure.

4. A fan defining an air flow direction, said fan comprising:

a support structure defining an axis of rotation thereof and defining opposed first and second faces transverse to the axis of rotation of said support structure; and a plurality of blades, each of said plurality of blades connected to said support structure, each of said plurality of blades having a length along a direction parallel to the axis of fan rotation of said support structure extending from a first side of said each of said plurality of blades to an opposed second side of said each of said plurality of blades and having a width transverse to its length and extending from a radially inward first end of said each of said plurality of blades to an opposed radially outward second end of said each of said plurality of blades, and extending along the length from a first face of said each of said plurality of blades to an opposed second face of said each of said plurality of blades; and a turning vane connected to the plurality of blades and positioned centrally along the length of the blades, said turning vane including a trailing edge secured to the internal periphery of said plurality of blades and a smoothly rounded nose extending radially inward from the trailing edge.

5. The fan of claim 4, wherein said turning vane is connected to the plurality of blades at the radially inward first end of said each of said plurality of blades.

6. The fan of claim 5, wherein said turning vane includes a smoothly-rounded entry nose and a thin extended trailing edge.

7. The fan of claim 5:

wherein said blades define an internal periphery of said blades; and wherein said turning vane includes a circular ring internally mounted to the internal periphery of the blades.

8. The fan of claim 5, further comprising a second turning vane spaced from said first mentioned turning vane.

9. The fan of claim 8, wherein said first mentioned turning vane and said second turning vane are different from each other.

10. The fan of claim 4, wherein said turning vane is connected to each of said plurality of blades at the radially inward first end of said each of said plurality of blades and positioned centrally along the length of the blades.

11. A fan defining axis of fan rotation and a direction of air flow, said fan comprising a plurality of blades, each of said plurality of blades having a length along a direction parallel to the axis of fan rotation extending from a first side of said one of said plurality of blades to an opposed second side of said one of said plurality of blades and having a width transverse to its length and extending from a radially inward first end of said one of said plurality of blades to an opposed radially outward second end of said one of said plurality of blades; and a turning vane connected to the plurality of blades at the radially inward first end of said each of said plurality of blades, said turning vane positioned centrally along the length of the blades, said turning vane including a trailing edge secured to the internal periphery of said plurality of blades and a smoothly rounded nose extending radially inward from the trailing edge.

12. The fan of claim 11, wherein said turning vane includes a smoothly-rounded entry nose and a thin extended trailing edge.

13. The fan of claim 12, further comprising a second turning vane spaced from said first mentioned turning vane.

14. A fan defining an axis of fan rotation and a direction of air flow, said fan comprising a plurality of blades, at least one of said blades having a length along a direction parallel to an axis of fan rotation extending from a first side of said one of said plurality of blades to an opposed second side of said one of said plurality of blades, at least one of the blades having a width transverse to its length; and a turning vane connected to the plurality of blades and positioned intermediately along the length of the blades, said turning vane including a trailing edge secured to the internal periphery of said plurality of blades and a smoothly rounded nose extending radially inward from the trailing edge.

15. The fan of claim 14, further comprising a second turning vane spaced from said first mentioned turning vane.

16. The fan of claim 14, wherein said turning vane is connected to each of said plurality of blades at the radially inward first end of said each of said plurality of blades and positioned centrally along the length of the blades.

* * * * *